US006612403B2

(12) United States Patent
Silberhorn et al.

(10) Patent No.: US 6,612,403 B2
(45) Date of Patent: Sep. 2, 2003

(54) METHOD AND APPARATUS FOR GENERATING ELEVATOR CAR POSITION INFORMATION

(75) Inventors: Gert Silberhorn, Küssnacht a. Rigi (CH); René Kunz, Lucerne (CH); Markus Schenkel, Dietikon (CH); Anton Gunzinger, Zürich (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 10/079,659

(22) Filed: Feb. 20, 2002

(65) Prior Publication Data

US 2002/0112926 A1 Aug. 22, 2002

(30) Foreign Application Priority Data

Feb. 20, 2001 (EP) ..... 01810174

(51) Int. Cl.[7] ..... B66B 3/02
(52) U.S. Cl. ..... 187/394
(58) Field of Search ..... 187/391, 393, 187/394, 312, 283, 397, 399

(56) References Cited

U.S. PATENT DOCUMENTS 3,963,098 A * 6/1976 Lewis et al. ..... 187/394
4,427,095 A * 1/1984 Payne et al. ..... 187/394
5,509,505 A * 4/1996 Steger et al. ..... 187/394
5,821,477 A 10/1998 Gerstenkorn
5,889,239 A * 3/1999 Blackaby et al. ..... 187/391
6,276,493 B1 * 8/2001 Lacarte Estallo ..... 187/391
6,283,253 B1 * 9/2001 Folli et al. ..... 187/394
6,435,315 B1 * 8/2002 Zaharia ..... 187/394

FOREIGN PATENT DOCUMENTS

EP 0 722 903 5/2000
JP 04338072 11/1992
JP 406156910 A * 6/1994 ..... B66B/3/02

* cited by examiner

*Primary Examiner*—Jonathan Salata
(74) *Attorney, Agent, or Firm*—MacMillan, Sobanski & Todd, LLC

(57) ABSTRACT

An apparatus and a method for generating hoistway information from images of the surface patterns of a hoistway component such as a guide rail sensed by a CCD line camera. The image data are input into a first correlator which uses an incremental position of a new image and an absolute position of a preceding image to generate an estimated position. The estimated position is input into a second correlator and is used to locate the relevant database sector in which the image which was stored in the database during calibration is situated. The second correlator compares the new image with the stored image and determines from the position index of the stored image the absolute position of the elevator car which is transmitted to the elevator control.

10 Claims, 2 Drawing Sheets

METHOD AND APPARATUS FOR GENERATING ELEVATOR CAR POSITION INFORMATION

BACKGROUND OF THE INVENTION

The present invention relates generally to a method of generating hoistway information to serve an elevator control and, in particular, to a method of generating hoistway information from an elevator hoistway with an elevator car that can travel in the hoistway, the hoistway information being generated from pictorially recognizable patterns.

The European patent specification EP 0 722 903 B1 shows a device for generating hoistway information from an elevator hoistway. In the elevator hoistway a reflector with a code is arranged in the vicinity of a stop for an elevator car. The code has two identical tracks. An approach zone of the stop, in which bridging of door contacts is allowed, lies half above and half below a leveling line. An adjusting zone, in which adjustment of an elevator car which is too low due to rope stretch is allowed with open car doors, lies half above and half below the leveling line. The code of the tracks is read and analyzed by a 2-channel analyzing device arranged on the elevator car. Transmitters of the analyzing device illuminate the tracks of the reflector. The illuminated surfaces of the tracks are captured on CCD sensors of the analyzing device and imaged by means of pattern recognition logic. Transformation of the images into information to serve the elevator control takes place by means of a computing device.

A disadvantage of this known device is that a code strip arranged in the elevator hoistway is necessary to generate patterns. The code strip must be arranged in the elevator hoistway precisely and without excessive stretching. Furthermore, it is not guaranteed that the code strip will not wholly or partly separate from the underlying support surface. Incorrect mounting or detachment of the code strip results in no, or incorrect, patterns.

SUMMARY OF THE INVENTION

The present invention provides a solution for avoiding the disadvantages of the above-described known device and proposes a system and a method with which generation of hoistway information serving an elevator control is guaranteed in all cases.

The method according to the present invention generates elevator hoistway information to an elevator control for an elevator car travelling in the hoistway comprising the steps of: a. providing a sensor on an elevator car travelling in a hoistway; b. sensing with the sensor pictorially recognizable patterns on at least one existing component of the hoistway, the existing component serving a function related to the hoistway other than proving the patterns; and c. generating from the patterns an absolute position signal representing an actual position of the elevator car in the hoistway. Step b. can be performed by generating images of sectors of the patterns and an incremental position of a current one of the images with respect to a preceding one of the images, and step c. can be performed by determining an absolute position of the current image from the incremental position and an absolute position of the preceding image.

The advantages achieved by means of the present invention include that no additional installation is needed in the hoistway. The installation time for the elevator can thereby be substantially shortened. An analyzing device provided with sensors and arranged on the elevator car suffices to generate the hoistway information. A very reliably operating and inexpensive hoistway information system with high resolution can be realized with the structures present in the elevator hoistway. The hoistway information system delivers an absolute position at startup without the elevator car traveling. Moreover, the system can store floor stopping positions and simulate the hoistway switches used hitherto for, for example, brake application, door zones, and emergency stopping, or other hoistway switches. The system is therefore compatible with existing elevator controls.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
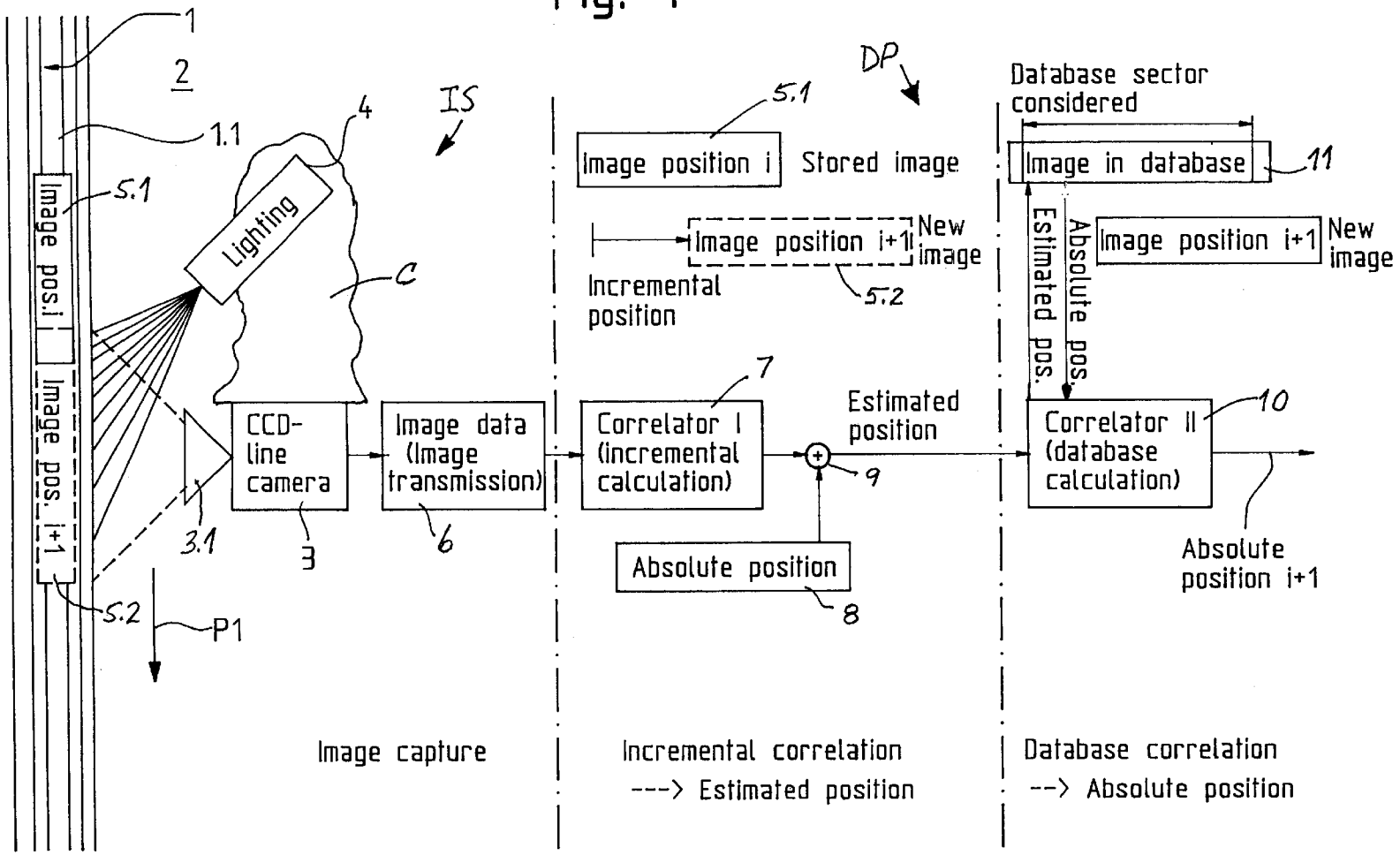
FIG. 1 is a schematic representation of an elevator hoistway information system according to the present invention.

FIG. 1 shows a system IS according to the present invention for generating hoistway information. A guide rail 1 is arranged in an elevator hoistway 2 and has a guide rail face 1.1. The guide rail 1 serves to guide an elevator car C able to travel in the elevator hoistway 2. The momentary direction of travel of the elevator car 2 is indicated with an arrow P1. Arranged on the elevator car C is a CCD line camera 3 with a lens system and CCD line sensor 3.1. The CCD line sensor 3.1 is arranged in the direction of travel P1 of the elevator car C and has, for example, 128 image elements. In this arrangement a first section 5.1 of, for example, the face 1.1 of the guide rail 1 with a length of, for example, 2 cm measured in the direction of travel P1, can be recorded. An image of the 2 cm section 5.1 of the guide rail 1 is formed. The image shows the surface structure, or surface pattern, of the guide rail section 5.1. The CCD line sensor 3.1 can, for example, on fast moving elevator cars, be operated with an image frequency of 1000 Hz, the light falling on the image elements being converted into electric charges. The electric charges are analyzed in the CCD line camera 3 and converted into image data by a data conversion means 6 which image data is transferred to a computer DP.

A light source 4 mounted on the elevator car C shines onto the guide rail section to be recorded, the light reflected from the guide rail section being converted into electric charges of the image elements of the CCD line sensor 3.1. To improve the image quality, flashed LED's or halogen lamps can be used for the light source 4. The light pattern shining on the guide rail 1 covers approximately one section such as the first section 5.1 or a second section 5.2 as shown in FIG. 1.

The image quality can be further improved by digital filtering and/or by certain methods of image processing. Instead of using the surface structure or surface pattern of the guide rail 1, it is possible, for example, for the surface structure or surface pattern of a wall of the elevator hoistway 2, or the surface structure or surface pattern of constructional parts (steel girders) of the elevator hoistway 2, to be recorded by the CCD line camera 3. The guide rails, walls, or constructional parts are components of the elevator hoistway 2 that do not serve primarily to generate hoistway information but fulfill their usual functions of guiding and/or supporting the elevator car and/or counterweight or supporting parts of the building.

To calibrate the hoistway information system IS, the elevator hoistway 2 is traveled by the car C. During this calibration travel, the surface structure or surface pattern recorded by the CCD line camera 3 is written in the memory of the computer DP together with a position index. To determine the stopping position for a floor, the elevator car C is driven to the desired height, the car position is read by the system IS, and the position value is stored as a reference value for the floor.

To increase safety, two redundant systems IS can be provided. One system records the surface structure or surface pattern of the one guide rail, while the other system records the surface structure or surface pattern of the other guide rail. As a variant, both systems can record the surface structure or surface pattern of the same guide rail. The output signals of the one system can be used as a training signal for the other system, and vice versa. If the surface structure or surface pattern of the one guide rail has changed since calibration, the new surface structure or the new surface pattern can be associated with the position data of the other system.

In FIG. 1, the image of the surface structure or surface pattern of the guide rail first section 5.1 of position "i" is represented by a solid line, the image having already been recorded and the related absolute position determined. FIG. 1 shows the system IS positioned for determining the image of the surface structure or surface pattern of the guide rail second section 5.2 of position "i+1". The new image at the position "i+1" is represented by a broken or dashed line and overlaps the image of the position "i". The image data are transferred to the computer with memory DP. A first correlator means 7 (correlator I) of the computer DP, implemented with software, calculates from the image of the first position "i" and the new image of the second position "i+1" an incremental or relative position. The output signal from the correlator means 7 and the absolute position signal "i" from a memory 8 are summed at a summing point 9 to generate an estimated position of the new image signal. The estimated position signal, of the new image with position "i+1", is transferred to a second correlator means 10 (correlator II) of the computer DP, implemented with software, which uses the estimated position to locate the relevant section of a database 11 in which the image written during calibration lies. As explained above, the stored image is provided with a position index. The correlator II 10 compares the new image of position "i+1" with the stored image, and determines from the position index the absolute position "i+1", which is transferred as an absolute position output signal to the elevator control.

Changes in the surface structure or surface pattern of the guide rail 1 that have occurred during the operation of the elevator can be continuously relearned by the database 11. When changes occur on the surface of the guide rail 1, the new images of the guide rail used for the incremental correlation are taken adaptively from the database.

As explained above, the CCD line camera 3 is provided with the lens system and CCD line sensor 3.1. Instead of the line sensor, a two-dimensional surface sensor can also be provided. The image elements of the dimension perpendicular to the direction of travel are averaged, which results in a one-dimensional brightness profile.

The speed "v" of the elevator car C can be determined from the difference between position "p1" at instant "t1" and position "p2" at instant "t2" by the formula:

$$v=(p2-p1)/(t2-t1)$$

Instead of the CCD line camera 3, a dual-sensor system can also be used with two LED's as light sources and two photoresistors as brightness detectors. When the elevator car C is traveling, the one signal is a time-delayed copy of the other signal. The two signals can be compared using correlation methods, and the speed of the elevator car can be determined from the time delay and the distance between the sensors. The position can be determined both by integration of the speed and by comparison with the data that was stored during calibration and subsequently continuously corrected.

In principle, the correlation means (7 or 10) compares a current image with, a reference image. A correlation window is first extracted and then slid over the reference image pixel-by-pixel. For each pixel in the window, the difference in the pixel gray value is determined, and then the sum of their squares is calculated. This method of calculation determines the length of the difference vector between two image vectors which correspond to the one-dimensional images.

The pixel-by-pixel calculation of correlation values also makes it possible to derive a reliability value. At the corresponding point the correlation values are at a minimum, because two quasi-identical images have a distance approximating to zero. To calculate a reliability value "ZW", the absolute minimum "aM", the second-best minimum "zM", and the standard deviation "S" over the entire correlation length are used. In practical use, values of "ZW" between six and ten occur with a threshold of, for example, five being used based upon the formula:

$$ZW=(zM-aM)/S$$

A very good reliability value occurs at lower speeds of the elevator car C, the incremental correlation (two successive images with overlap) and the database correlation (complete image of the guide rail surface 1.1 in the database) being good.

If the guide rail surface 1.1 has undergone change, a good reliability value occurs at lower speeds of the elevator car C, the incremental correlation (two successive images with overlap) being good, and the database correlation (incomplete representation of the guide rail surface in the database) being poor.

If the guide rail surface 1.1 has not undergone change, a good reliability value occurs at higher speeds of the elevator car C, the incremental correlation (two successive images with hardly usable overlap) being poor, and the database correlation (complete representation of the guide rail surface in the database) being good.

If the guide rail surface 1.1 has undergone change, a poor reliability value occurs at higher speeds of the elevator car C, the incremental correlation (two successive images with hardly usable overlap) being poor, and the database correlation (incomplete representation of the guide rail surface in the database) being poor.

Figure 2:
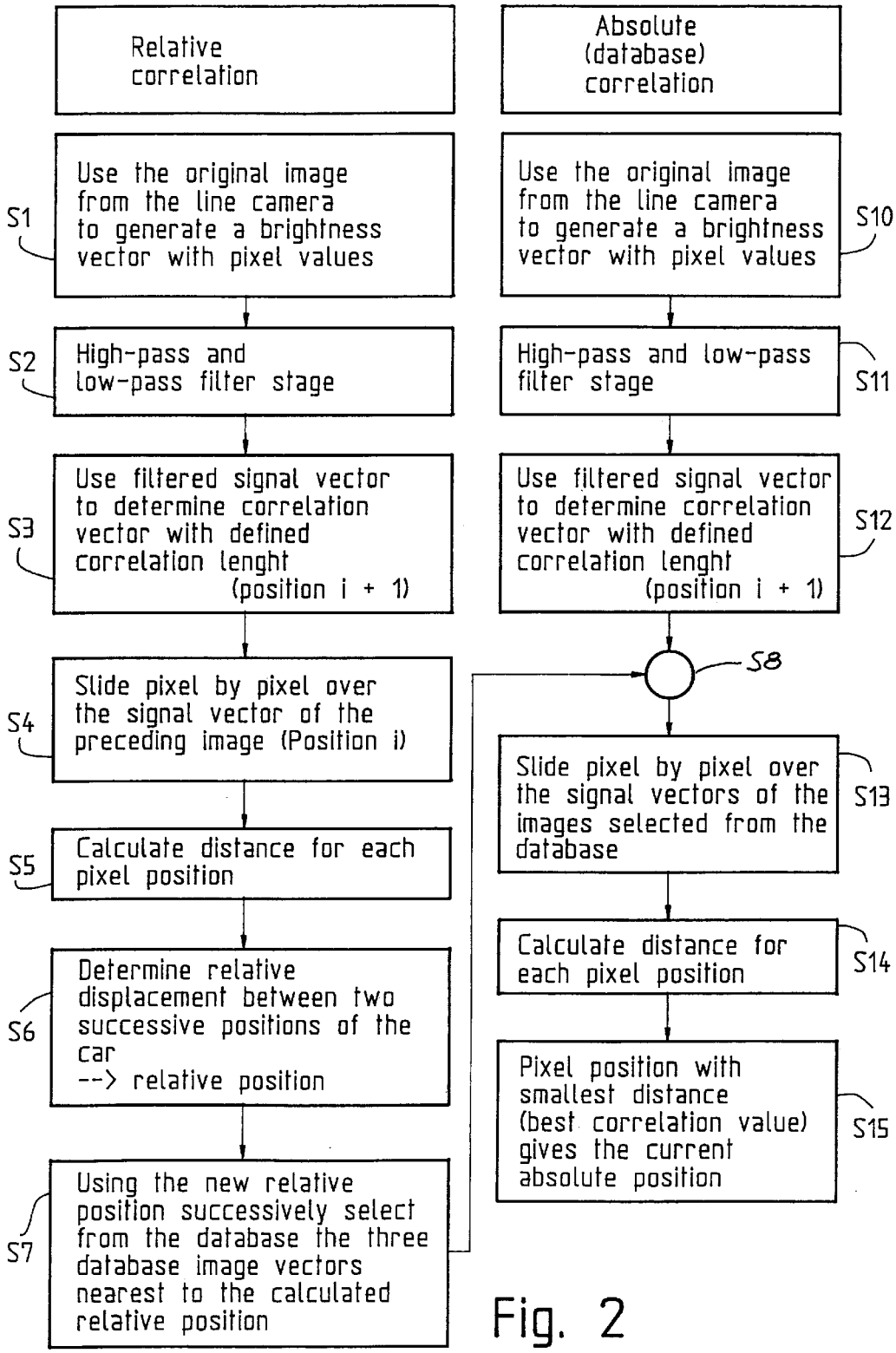
FIG. 2 is a flow diagram of a method according to the present invention for determining an incremental or relative position of a sensed section of a hoistway structure and for determining an absolute position of the sensed section.

FIG. 2 shows the procedure according to the present invention for determining an incremental, or relative, position of a recorded section of, for example, the guide rail 1. In a left column of the flow diagram entitled "Relative Correlation", the first correlator I 7 of the computer DP, implemented in software, calculates from the image of position "i" and the new image of position "i+1" an incremental, or relative, position. In a first step S1, a one-dimensional image with picture elements, or pixels, is extracted or generated from the image data of the CCD line camera 3. Following this, in a step S2, the image, which is also referred to as an image vector or brightness vector, is then taken through a high-pass and low-pass filter stage. By processing the image vector or brightness vector with a high-pass filter, external disturbing influences regarding the illumination profile are suppressed. By processing the image vector or brightness vector with a low-pass filter, thermal noise of the CCD line camera 3 is eliminated. In a step S3, a correlation window or correlation vector with defined length is taken from the processed image vector or brightness vector of position "i+1", the correlation window in a step S4 being slid over the image vector of the preceding image "i". In step S5, the distance between pixel "i+1" and pixel "i" is calculated for each pixel. After this, in a step S6, the relative displacement between the image of position "i" and the image of position "i+1" is determined. In FIG. 1 the relative position is designated as the incremental position. In a step S7, the relative position is added to the preceding absolute position "i". The new absolute position, which in FIG. 1 is designated as the absolute position, is the reference for locating the relevant section of the database. In a step S7, three, for example, of the image vectors of the image database which are closest to the new absolute position are selected and input to a step S8 in a right column of the flow diagram.

In the right column of the flow diagram entitled "Absolute (Database) Correlation" there is shown the process for determining an absolute position of a recorded section of, for example, the guide rail 1. The second correlator II 10 of the computer, implemented with software, calculates from the image of position "i" and the new image of position "i+1" an absolute position. In a step S10, a one-dimensional image with picture elements, or pixels, is extracted or generated from the image data of the CCD line camera 3. Following this, in a step S11, the image, which is also referred to as an image vector or brightness vector, is then taken through a high-pass and low-pass filter stage. By processing the image vector or brightness vector with a high-pass filter, external disturbing influences regarding the illumination profile are suppressed. By processing the image vector or brightness vector with a low-pass filter, thermal noise of the CCD line camera 3 is eliminated. In a step S12, a correlation window or correlation vector with defined length is taken from the processed image vector or brightness vector of position "i+1". The image vectors from the steps S7 and S12 are associated in the step S8 and, in a step S13 the correlation window of the step S12 is slid over the image vectors taken from the image database in the step S7. In a step S14, the distance between pixel "i+1" and pixels taken from the image database is calculated for each pixel. Following this, in step S15, the pixel "i+1" with the smallest distance is determined (closest match), and from this results the current actual position signal generated at the output of the correlation means 10 of FIG. 1.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of generating elevator hoistway information to an elevator control for an elevator car travelling in the hoistway comprising the steps of:

a. providing a sensor on an elevator car travelling in a hoistway;

b. sensing with the sensor pictorially recognizable patterns on at least one component of the hoistway, the at least one component serving a function related to the hoistway other than proving the patterns the patterns being a natural surface structure of the at least one component not intended to provide position information; and c. generating from the patterns an absolute position signal representing an actual position of the elevator ear in the hoistway.

2. The method according to claim 1 wherein said step b. is performed by generating images of sectors of the patterns and an incremental position of a current one of the images with respect to a preceding one of the images, and said step c. is performed by determining an absolute position of the current image from the incremental position and an absolute position of the preceding image.

3. The method according to claim 1 wherein said step c. is performed by determining a relative position from the overlap of the current image at a position "i+1" with the preceding image at a position "i", determining an estimated position from the relative position and an absolute position of the image at "i", locating a sector of an image database associated with the estimated position, and comparing a stored image at the located database sector with the current image to determine the absolute position of the current image.

4. The method according to claim 3 wherein said comparing step is performed by a comparison of individual pixels of the current image and the stored image, the distance from a pixel in the current image to a corresponding pixel in the stored image serving as criterion for determining the absolute position of the current image.

5. The method according to claim 3 including generating a reliability value based upon a pixel by pixel comparison of the current image with the stored image.

6. The method according to claim 3 including a step of generating the image database by moving the elevator car through the elevator hoistway and recording in the database images of the patterns sensed in said step b. at associated sectors in the database.

7. The method according to claim 1 wherein the patterns are on a surface structure of one of a guide rail mounted in the elevator hoistway and a wall of the elevator hoistway.

8. The method according to claim 1 wherein the sensor includes a CCD line camera for sensing the patterns and said step c. is performed by a programmed computer with a memory for recording the patterns and determining the actual position of the elevator car.

9. An apparatus for generating elevator hoistway information to an elevator control for an elevator car travelling in the hoistway comprising;

a sensor mounted on an elevator car travelling in a hoistway for sensing pictorially recognizable patterns on at least one component of the hoistway, the at least one component serving a function related to the hoistway other than proving the patterns and the patterns being a natural surface structure of the at least one component not intended to provide position information, and generating images of the patterns;

a first correlator means for determining an overlap between a current one of the images and a preceding one of the images and generating an estimated position signal; and a second correlator means for generating an absolute position signal representing an actual position of the elevator car in the hoistway from a comparison of said estimated position signal with the images of the patterns stored in a database.

10. The apparatus according to claim 9 wherein said sensor includes a CCD line camera for generating said images.

* * * * *